US011802692B2

(12) United States Patent
Gao et al.

(10) Patent No.: US 11,802,692 B2
(45) Date of Patent: Oct. 31, 2023

(54) MONOLITHIC GAS TRAP ADSORBER FOR HIGH EFFICIENCY, COST EFFECTIVE, LOW-EMISSION CONDENSING FURNACE

(71) Applicant: UT-Battelle, LLC, Oak Ridge, TN (US)

(72) Inventors: Zhiming Gao, Oak Ridge, TN (US); Ayyoub M. Momen, Oak Ridge, TN (US); Josh A. Pihl, Oak Ridge, TN (US); Timothy J. LaClair, Oak Ridge, TN (US); Bo Shen, Oak Ridge, TN (US); Xiaobing Liu, Oak Ridge, TN (US); Kyle R. Gluesenkamp, Oak Ridge, TN (US); James E. Parks, II, Oak Ridge, TN (US); Puxian Gao, Oak Ridge, TN (US); Alex E. Pawlowski, Oak Ridge, TN (US); Kashif Nawaz, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 358 days.

(21) Appl. No.: 17/232,274

(22) Filed: Apr. 16, 2021

(65) Prior Publication Data

US 2021/0325038 A1 Oct. 21, 2021

Related U.S. Application Data

(60) Provisional application No. 63/011,319, filed on Apr. 17, 2020.

(51) Int. Cl.
*F23J 3/04* (2006.01)
*F23J 15/02* (2006.01)

(52) U.S. Cl.
CPC ..... *F23J 3/04* (2013.01); *F23J 15/02* (2013.01); *F23J 2215/10* (2013.01); *F23J 2215/20* (2013.01); *F23J 2900/15022* (2013.01); *F27M 2003/165* (2013.01)

(58) Field of Classification Search
CPC .. F23J 3/04; F23J 15/02; F23J 2215/10; F23J 2215/20
See application file for complete search history.

(56) References Cited

U.S. PATENT DOCUMENTS 3,987,146 A * 10/1976 Clay ..... B01D 53/60 423/239.1
5,022,226 A * 6/1991 Bell ..... F01N 5/02 60/274
5,065,576 A * 11/1991 Kanazawa ..... F01N 13/0097 60/299

(Continued)

*Primary Examiner* — David J Laux
(74) *Attorney, Agent, or Firm* — WARNER NORCROSS + JUDD LLP

(57) ABSTRACT

An improved method and system for treating flue gases from a natural gas furnace are provided. The method and system include an acidic gas trap (AGT) adsorber which enables the continuous adsorption and storage of SOx, NOx redox, and formic acid/CO/HC/$CH_4$ oxidation, with a negligible pressure drop. The AGT adsorber includes a catalyst coating having a nanotube structure (e.g., a uniform nanostructure forest coating) or a uniform porous nanostructure of various low-cost oxides through scalable low temperature solution processes, including oxides of Ti, Cu, Ba, Mn, Zr, Zn, Sr, Ca, Li, K, Na, Al, or Ce.

10 Claims, 10 Drawing Sheets

(56) References Cited

U.S. PATENT DOCUMENTS

| | | | | | |
|---|---|---|---|---|---|
| 5,178,101 | A * | 1/1993 | Bell | B01D 53/8625 | 110/212 |
| 5,224,334 | A * | 7/1993 | Bell | F23C 13/00 | 423/239.1 |
| 5,500,194 | A * | 3/1996 | Bell | B01D 53/8656 | 423/239.1 |
| 6,037,307 | A * | 3/2000 | Campbell | B01D 53/8603 | 502/353 |
| 7,824,636 | B1 * | 11/2010 | Kraemer | F23J 15/003 | 422/111 |
| 8,227,373 | B1 * | 7/2012 | Azad | B01J 23/10 | 502/343 |
| 2002/0104528 | A1 * | 8/2002 | Staller | F24B 1/1808 | 126/512 |
| 2012/0192849 | A1 * | 8/2012 | Alphs | F24H 8/00 | 126/112 |
| 2012/0213683 | A1 * | 8/2012 | Kato | B01D 53/90 | 423/224 |
| 2014/0018234 | A1 * | 1/2014 | Doering | B01J 35/023 | 502/309 |
| 2014/0050626 | A1 * | 2/2014 | Heidenreich | B01D 53/565 | 422/139 |
| 2014/0060400 | A1 * | 3/2014 | Park | B01D 53/02 | 110/236 |
| 2015/0024374 | A1 * | 1/2015 | Palti | B01D 69/04 | 435/2 |
| 2017/0095807 | A1 * | 4/2017 | Xiao | B29C 48/022 | |
| 2019/0060877 | A1 * | 2/2019 | Zedan | B01J 37/009 | |
| 2020/0030774 | A1 * | 1/2020 | Gao | B01J 37/10 | |
| 2020/0033027 | A1 * | 1/2020 | Kim | F24H 3/065 | |
| 2020/0061537 | A1 * | 2/2020 | Seng | B01D 53/96 | |

* cited by examiner

EXAMPLE CUBIC AGT CATALYST

MONOLITHIC GAS TRAP ADSORBER FOR HIGH EFFICIENCY, COST EFFECTIVE, LOW-EMISSION CONDENSING FURNACE

CROSS-REFERENCE TO RELATED APPLICATIONS

This application claims the benefit of U.S. Provisional Application 63/011,319, filed Apr. 17, 2020, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to the removal of sulfur oxides (SOx) and nitrogen oxides (NOx) from combustion waste gases, primarily from natural gas furnaces.

BACKGROUND OF THE INVENTION

Natural gas furnaces are the most common type of space heating equipment used in U.S. residential and commercial buildings. However, natural gas furnaces face serious corrosion and fouling problems. When flue gases cool down below the dew points of acidic gases (e.g., SOx and NOx), they condense and combine with water vapor to produce acidic solutions, which can lead to corrosion and fouling. There are currently two strategies for avoiding corrosion and fouling: (1) maintaining the combustion waste gases above their dew point temperature; or (2) using corrosion-resistant stainless steel heat exchangers. However, the acid dew point for $SO_3$ can be as high as 115-150° C. under natural gas combustion conditions. Maintaining the exhaust above this temperature reduces the efficiency of a furnace significantly. The use of corrosion-resistant stainless steel heat exchangers can reduce flue gas temperatures to less tan 40° C., but significantly drive up costs. In addition, these condensing furnaces inevitably generate substantial acidic water, as well as NOx, CO, HC and methane emissions, exacerbating long-term environmental issues related to soil, water and air. Moreover, condensing furnaces cannot vent through a chimney or other common venting system because the acidic condensate could etch concrete and put holes in metal flue pipes if it is not stainless steel. The combination of higher furnace cost, expensive installation, and more maintenance limits the penetration of high-efficiency condensing furnaces in the market.

Pipeline natural gas is a relatively clean fuel that contains 1-4 PPM of typical sulfur content, the majority of which is sulfur odorant compounds that are typically added in order to detect gas leaks for safety purposes. NOx is generated by the natural gas combustion process but can be minimized through burner design. The relatively low acid content of natural gas burner exhaust relative to other fuels presents an opportunity for the development of innovative acidic gas adsorption technologies for solving the constraints of acid gases and corrosion problems, as well as emission controls, thereby significantly improving natural gas furnace efficiency and cost effectiveness.

Adsorption technologies and adsorption catalysts have been successfully and widely applied in automobile emission controls. The best known example is the lean NOx trap (LNT), which uses alkali or alkaline earth metals (e.g., BaO) to adsorb SOx and NOx emissions, which are periodically released and catalytically reduced. Compared to automobile engine exhaust, SOx/NOx emissions from natural gas furnaces are relatively low. Therefore, developing a low-cost acid gas trap using adsorption technologies can provide a feasible pathway to make gas furnaces more efficient at lower costs.

SUMMARY OF THE INVENTION

An improved method and system for treating flue gases from a natural gas furnace are provided. The method and system include an acidic gas trap (AGT) adsorber which enables the continuous adsorption and storage of SOx, NOx redox, and formic acid/CO/HC/$CH_4$ oxidation, with a negligible pressure drop. The AGT adsorber includes a catalyst coating having a nanotube structure (e.g., a uniform nanostructure forest coating) or a uniform porous nanostructure of various low-cost oxides through scalable low temperature solution processes, including oxides of Ti, Cu, Ba, Mn, Zr, Zn, Sr, Ca, Li, K, Na, Al, or Ce.

In one embodiment, the method includes positioning the AGT adsorber in an exhaust flow path between a primary heat exchanger and a secondary heat exchanger. The method then includes contacting the AGT adsorber with a combustion waste gas from a natural gas furnace. The AGT adsorber includes a catalyst coating on a flow-through monolithic substrate. The catalyst coating includes a metal oxide sorber component for SOx trapping, NOx redox, and formic acid/CO/HC/$CH_4$ oxidation from the combustion waste gas. The metal oxide sorber component can include oxides of Ti, Cu, Ba, Mn, Zr, Zn, Sr, Ca, Li, K, Na, Al, or Ce, and the catalyst coating can further comprise Pt, Rh, or Pd. The flow-through monolithic substrate can be wash coated with titanium dioxide followed by the application of platinum nanoparticles and cupric oxide.

In another embodiment, the AGT adsorber is in a flow path between a tubular heat exchanger and a tube and fin heat exchanger. The flow-through monolithic substrate is surrounded by a shell canister, and a silica mat is positioned between the flow-through monolithic substrate and the shell canister. The substrate comprises a cordierite or stainless-steel honeycomb structure, and further optionally comprises manganese oxide nanowire or zinc oxide that is wash coated with $BaCO_3$ nanoparticles. The catalyst coating comprises nanostructures that are oriented in a substantially non-parallel direction with respect each other.

The AGT adsorber of these and other embodiments enables ultra-clean flue gases and neutral condensate that is environmentally friendly. The neutral condensate can be released directly to sewer systems, eliminating a secondary drainage system or a condensate neutralizer. Natural gas furnaces equipped with an AGT adsorber can achieve approximately 100% SOx trapping, more than 95% NOx redox, and can oxidize CO/HC/$CH_4$ and formic acid to recover additional energy from unburnt CO/HC/CH4, improving the annual fuel utilization efficiency (AFUE) of the furnace by an additional 0.5% to 1.5%. The AGT adsorber can also be applied to natural gas residential and rooftop furnaces, gas-fired water heaters, combustion boilers, and other combustion devices which generate SOx/NOx acidic emissions. The AGT adsorber can receive an off-line regeneration of the catalyst once every three years under normal expected use conditions. The AGT adsorber can be disassembled from the furnace to carry out its regeneration and the trapped SOx can be recycled in an off-line regen reactor facility. Lastly, the AGT adsorber can combine other novel catalysts, for example improved CO/HC oxidation et al., to enhance complex emissions reduction.

These and other features of the invention will be more fully understood and appreciated by reference to the description of the embodiments and the drawings.

DETAILED DESCRIPTION OF THE CURRENT EMBODIMENT

Figure 1:
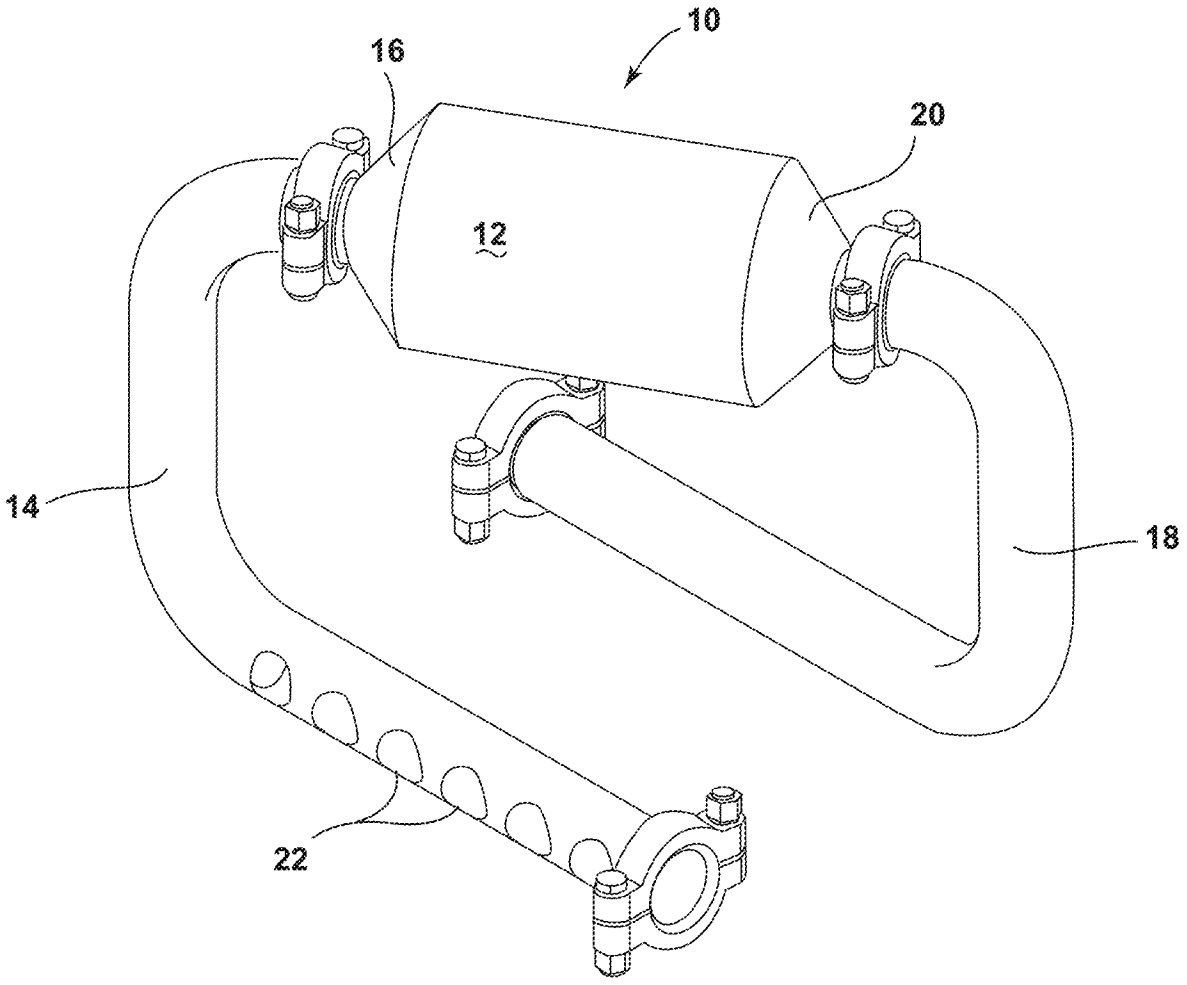
FIG. 1 includes a perspective view of an AGT adsorber in accordance with an embodiment of the present invention.
Figure 2:
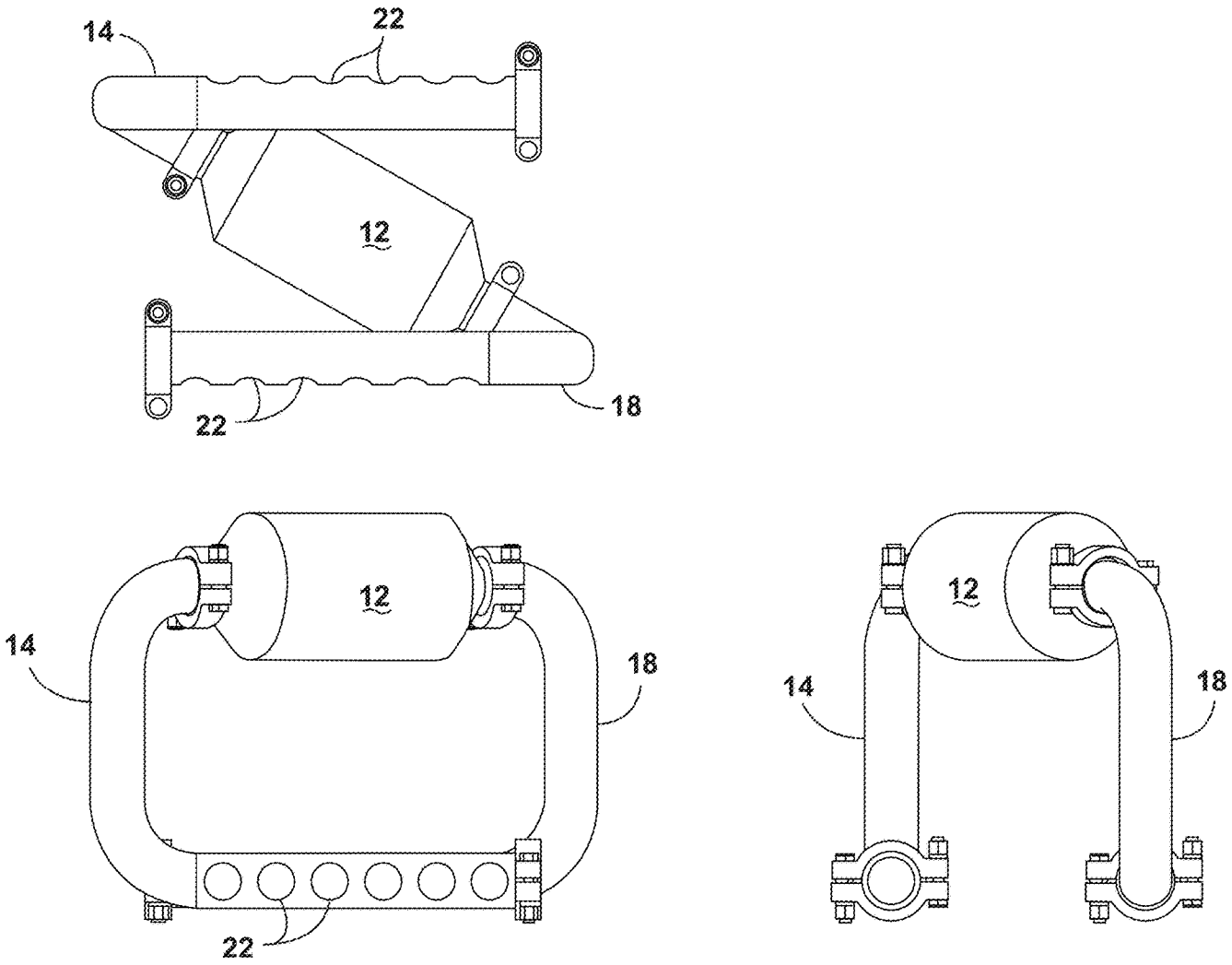
FIG. 2 includes first and second side views and a bottom view of the AGT adsorber of FIG. 1.

As discussed herein, the current embodiments include an acidic gas trap (AGT) adsorber and a method for treating flue gases. Referring to FIGS. 1-2, an AGT adsorber is illustrated and designated 10. The AGT adsorber 10 includes a shell canister 12 that contains a flow-through monolithic substrate for the removal of SOx, NOx, and other emission compounds from combustion waste gases. An inlet conduit 14 is joined to a divergent cone 16 on an upstream side of the shell canister 12, and an outlet conduit 18 is joined to a convergent cone 20 on a downstream side of the shell canister 12. Each of the inlet conduit 14 and the outlet conduit 18 include side channel openings 22 for connection to primary or secondary heat exchangers, which are discussed below in connection with FIG. 5. The shell canister 12, divergent cone 16, convergent cone 20, inlet conduit 14, and outlet conduit 18 are formed from low-cost steel materials and are welded together for providing a leak-tight flow path for natural gas furnace flue gases.

Figure 3:
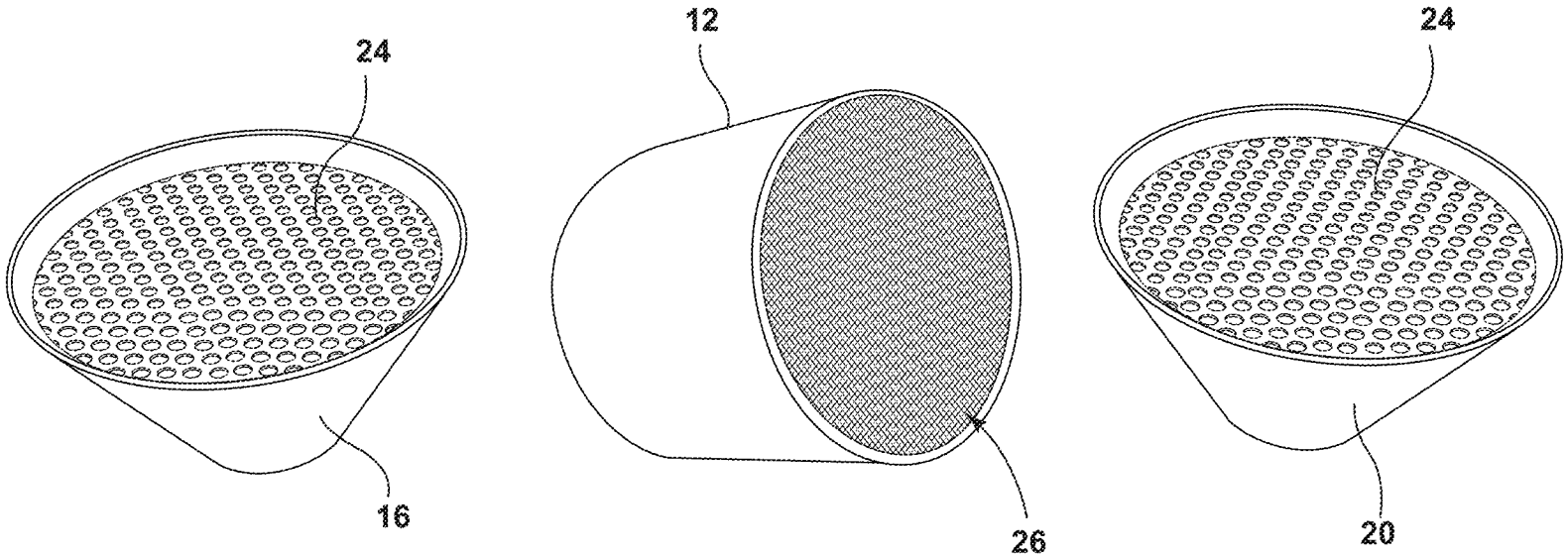
FIG. 3 includes views of sub-components of the AGT adsorber illustrated in FIGS. 1-2.
Figure 4:
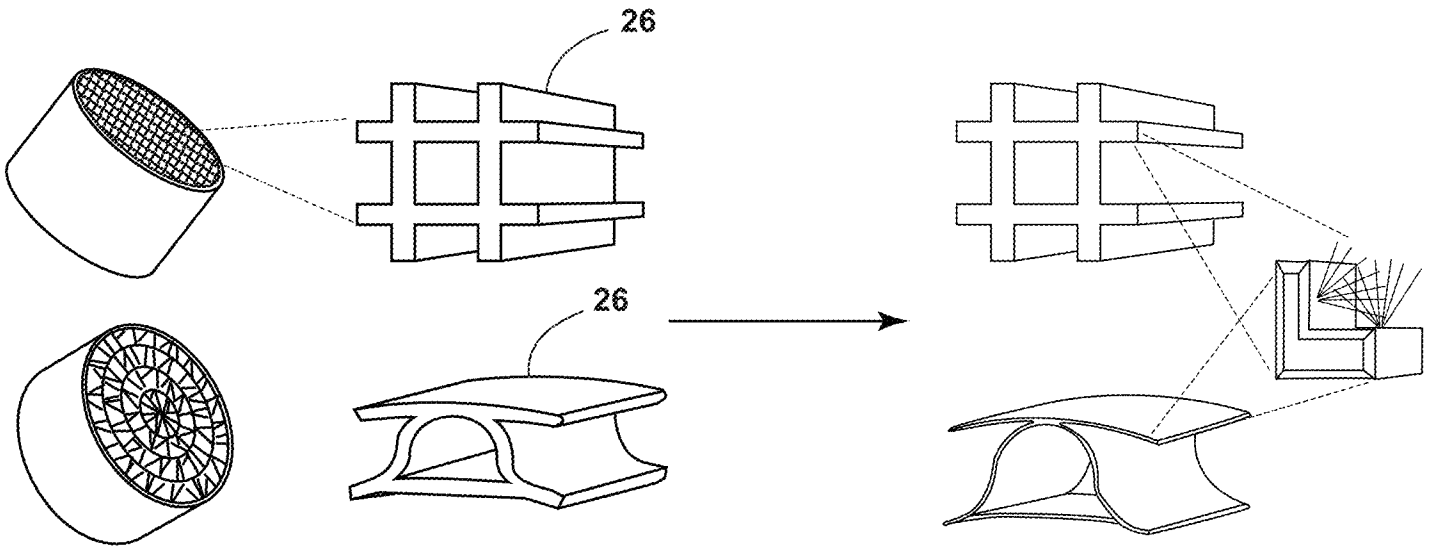
FIG. 4 includes drawings of a flow-through monolithic substrate including a catalyst coating.

As shown in FIG. 3, the divergent cone 16 and the convergent cone 20 include a metal grating 24 adjacent the shell canister 12. The shell canister 12 houses a flow-through monolithic substrate 26 therein, the flow-through monolithic substrate 26 defining a plurality of channels extending longitudinally therethrough from the divergent cone 16 to the convergent cone 20. The plurality of channels can have a honeycomb structure, as shown in FIG. 4 for example. The monolithic substrate may include or may be formed from a silicate (e.g., cordierite) or stainless steel. An optional silica mat (not shown) may be disposed between the shell 12 and the flow-through monolithic substrate 26, which fixes the substrate 26 within the shell 12 and absorbs any vibrations. The metal gratings 24 prevent lateral movement, relative to the length of the shell canister 12, of the substrate 26 within the shell canister 12. The shell canister 12 includes a 2-liter volume in the illustrated embodiment, but can include other volumes in other embodiments.

As shown in FIG. 4, the channel surfaces of the flow-through monolithic substrate 26 are covered with a wash-coating catalyst coating or a robust and uniform nanostructure catalyst coating. The catalyst coating includes a plurality of nanotubes (e.g., a forest growth nanostructure). The catalyst coating may include or may be formed from alkali or alkaline earth metal oxides (e.g., Ti, Cu, Ba, Mn, Zr, Zn, Sr, Ca, Li, K, Na, Al, or Ce). The catalyst coating may include, or may be formed from, or may be free of, precious metals (e.g., Pt, Rh or Pd). For example, the flow-through monolith substrate can be washcoated with $TiO_2$ followed by the application of platinum nanoparticles and cupric oxide for SOx trapping, NOx redox, and CO/HC/$CH_4$ and formic acid oxidization. As another example, the catalyst coating can include a ZnO nanoarray that is wash coated with $BaCO_3$ nanoparticles (ZnO/$BaCO_3$) or manganese oxide nanowire with a cryptomelane structure (MnOx) for trapping SOx/NOx acidic gases. Still other catalyst coatings are possible in other embodiments. Acidic gases such as SOx are continuously adsorbed and stored passively on the supported surface of the catalysts, and NOx can be trapped or reduced to $N_2$ on the supported surfaced of the catalysts, depending on coating materials. The flow-through monolithic substrate 26 has a fixed capacity for acidic gas storage, which decreases as the flow-through monolithic substrate 26 progressive adsorbs more acidic gases. However, a brief regeneration period can restore the capacity of the AGT adsorber, and the acidic gas can be recycled or neutralized before release in order to protect the environment.

A method according to one embodiment includes the application of an AGT adsorber to treat flue gases from a natural gas furnace. The AGT adsorber is positioned in a flow path between a primary heat exchanger and a secondary heat exchanger and is contacted with a combustion waste gas from a natural gas furnace. The AGT adsorber traps SOx, NOx redox, and oxide formic acid/CO/HC/$CH_4$ emissions that are present in the combustion waste gas while maintaining high efficiency and low cost operation.

Figure 5:
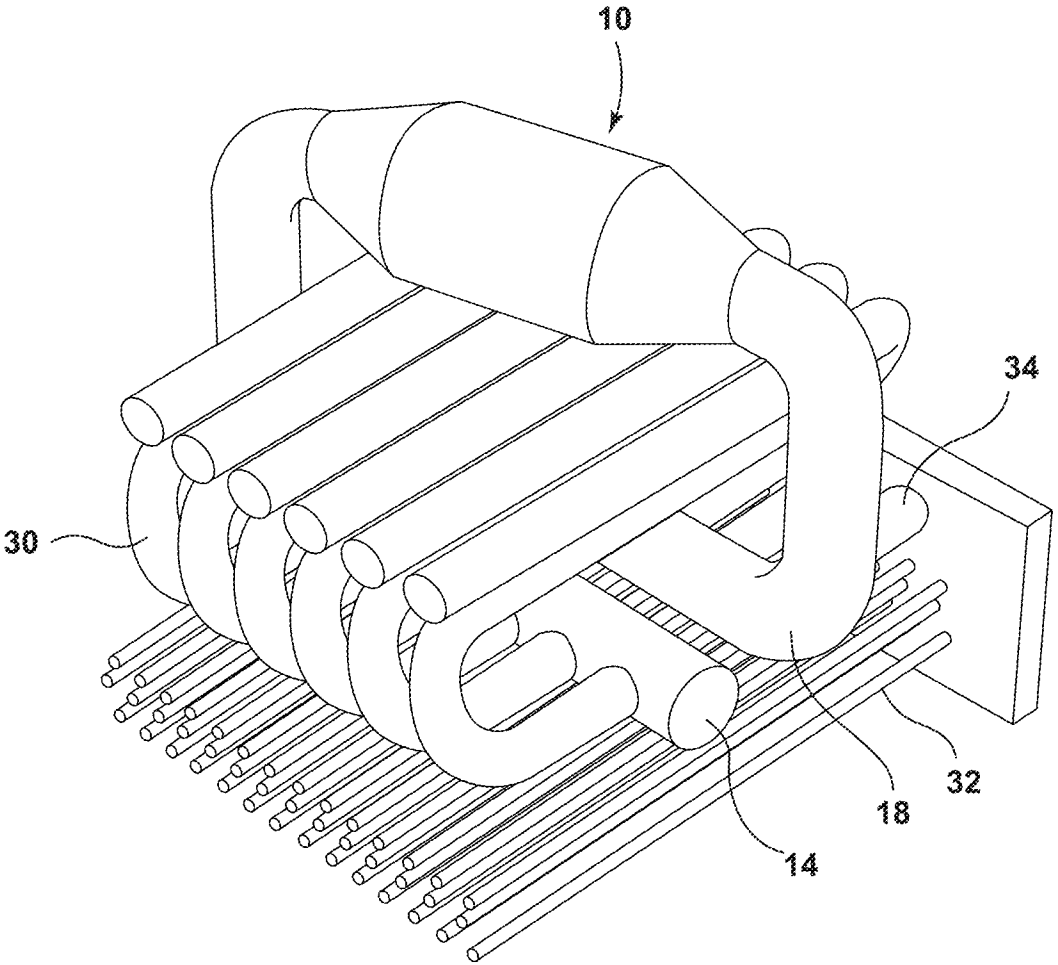
FIG. 5 includes a perspective view of an AGT adsorber in a flow path between a primary heat exchanger and a secondary heat exchanger.

FIG. 5 depicts one example of the AGT adsorber 10 coupled to a primary heat exchanger 30 and a secondary heat exchanger 32. The primary heat exchanger 30 comprises an array of serpentine-shaped heat exchange conduits branching off of the inlet conduit 18. The secondary heat exchanger 32 comprises a fin-and-tube type heat exchanger for recovering heat from the condensing vapor and minimizing exhaust temperatures. In operation, the flue gases enter the primary heat exchanger 30 at a temperature of approximately 900° C. The flue gases then enter the AGT adsorber 10 for removal of gaseous sulfur compounds and gaseous nitrogen compounds. The AGT adsorber 10 is in fluid communication with the secondary heat exchanger 32 through an outlet manifold 34 comprising multiple conduits that branch off of the outlet conduit 18. The flue gases, with 99% of the acidic gases removed, proceeds through the outlet manifold 34 to the secondary heat exchanger 32. The secondary heat exchanger 32 is positioned in the forced-air supply upstream of the primary heat exchanger 30, such that forced air passes over the secondary (fin-and-tube) heat exchanger 32 before passing over the primary heat exchanger 30. The primary heat exchanger 30 allows the AGT adsorber 10 to operate at optimal temperatures for absorbing SOx and NOx redox, and the secondary heat exchanger 32 recovers heat from the condensing vapor (collecting neutral condensate) and minimizes the exhaust temperature of the flue gases.

Figure 6:
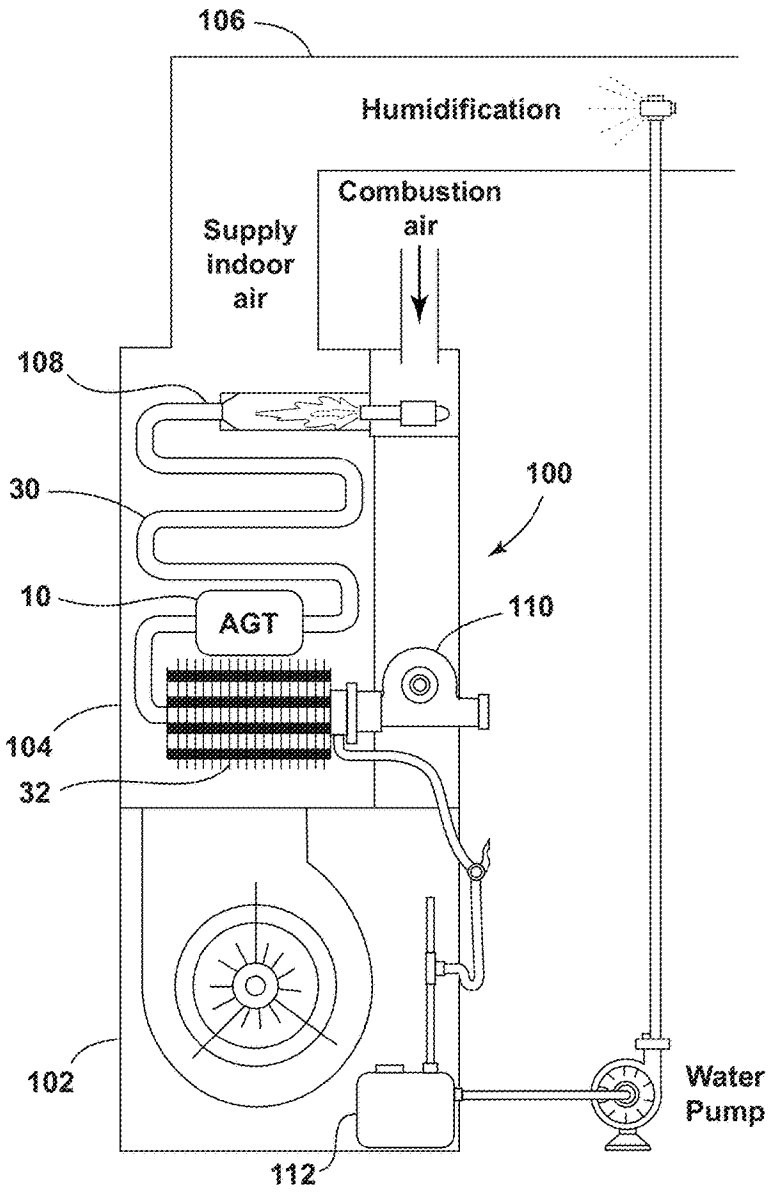
FIG. 6 is a schematic view of a natural gas furnace including an AGT adsorber in accordance with one embodiment of the present invention.

FIG. 6 depicts one example of the AGT adsorber 10 integrated into a natural gas furnace 100. Return air enters the blower cabinet 102 and proceeds to the air heating cabinet 104 where it passes over the secondary (fin-and-tube) heat exchanger 32. The now-heated air passes over the AGT adsorber 10 and primary (tubular) heat exchanger 30, where it is further heated, before entering the air supply plenum 106. While in the air supply plenum 106, the heated air is optionally humidified with neutral condensate extracted from flue gases. Combustion air enters the furnace and, once combusted, enters the exhaust gas flow path 108. The exhaust gas flow path 108 proceeds through the primary (tubular) heat exchanger 30, the AGT adsorber 10, and the secondary (fin-and-tube) heat exchanger 32, being drawn by an induced draft fan 110. Neutral condensate extracted at the secondary heat exchanger 32 are collected at a condensate reservoir 112 as an optional water source for humidification of the supply indoor air.

Figure 7:
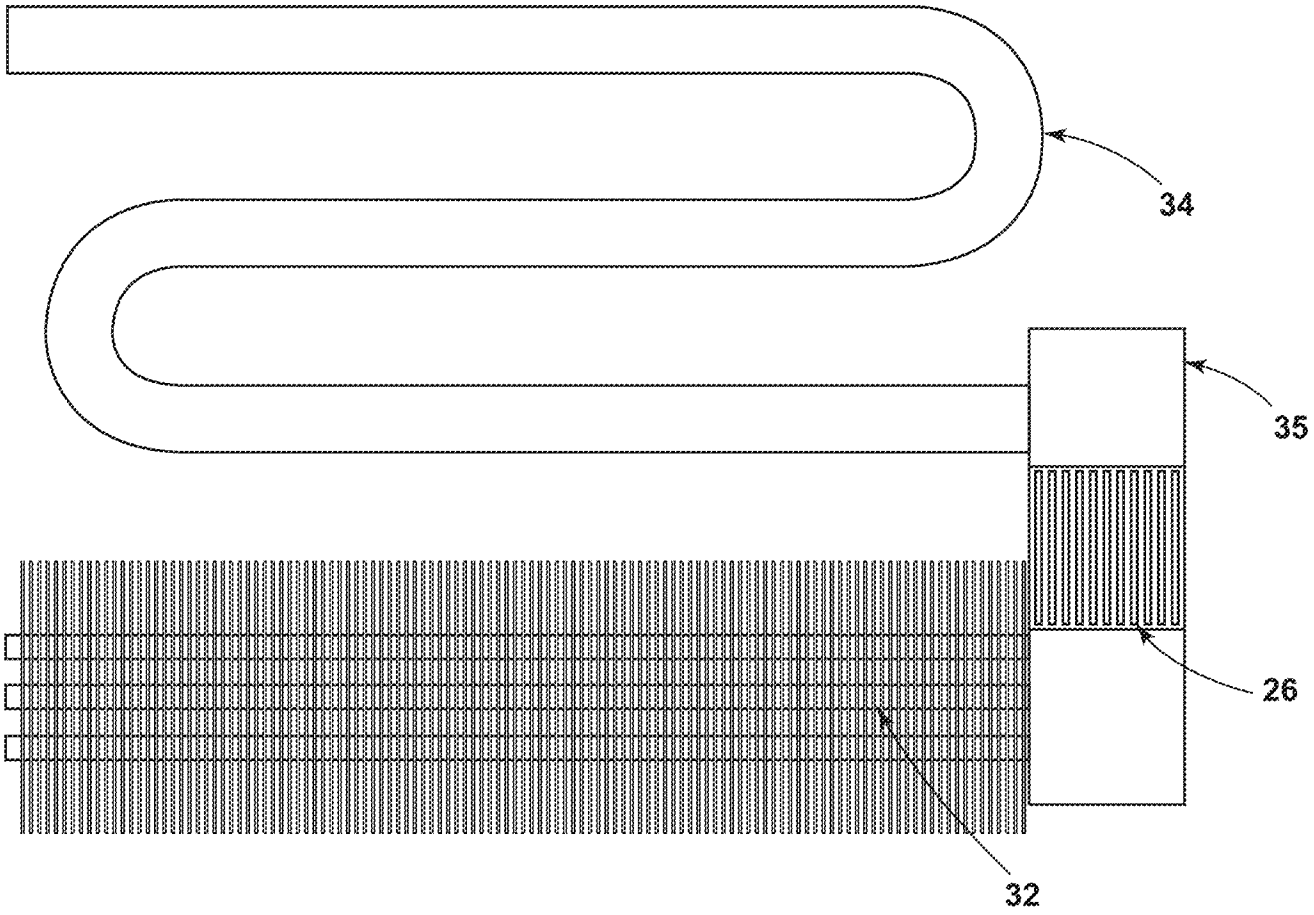
FIG. 7 is a schematic view of an alternative integration of an AGT adsorber in a coupling box between a primary heat exchanger and a secondary heat exchanger.
Figure 8:
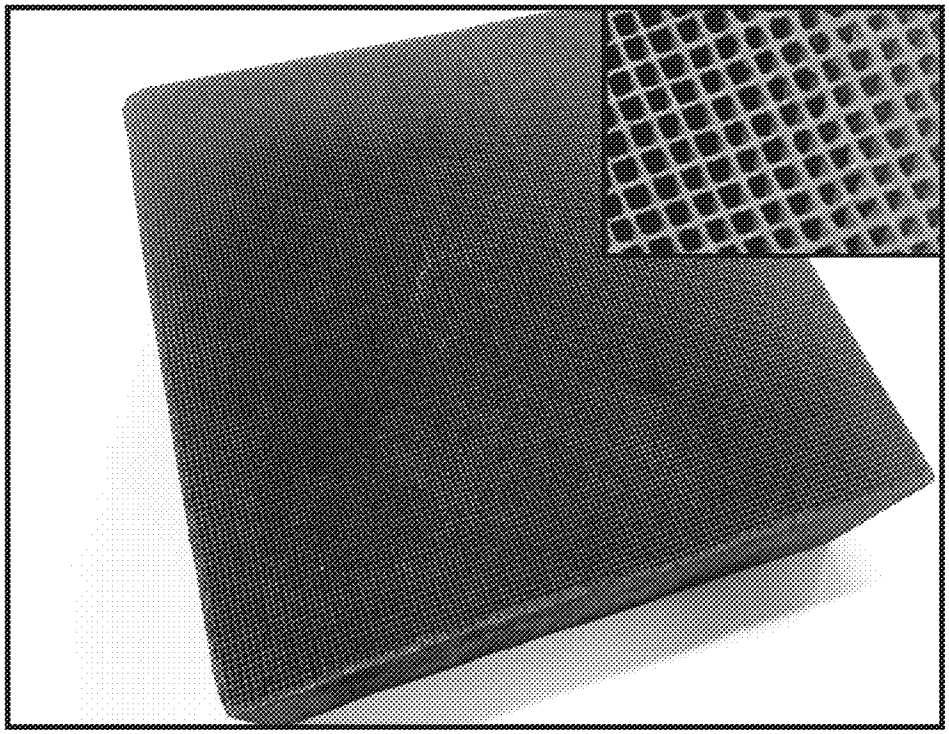
FIG. 8 includes drawings of an alternative flow-through monolithic substrate including a catalyst substrate coating for the AGT adsorber of FIG. 7.
Figure 8:
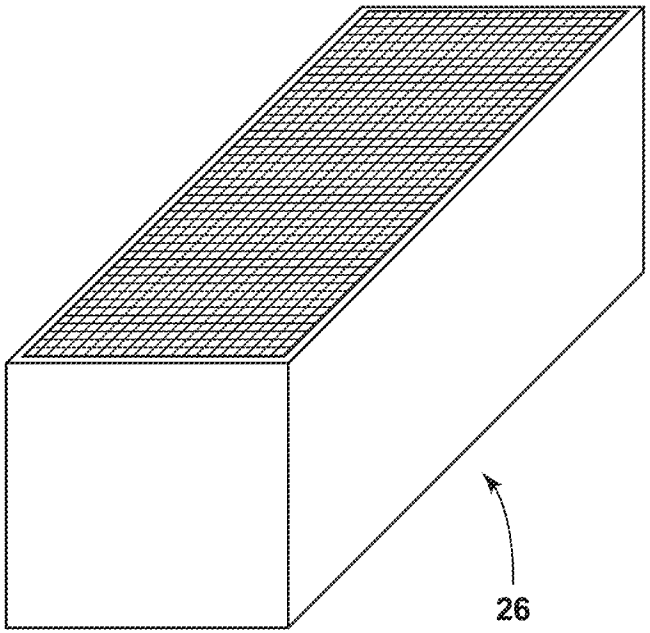

FIG. 7 depicts an alternative example of the AGT adsorber 10 installed in a coupling box 35 for placing the discharge ports of a primary heat exchanger 30 in fluid communication with the inlet ports of a secondary heat exchanger 32. In operation, the flue gases leave the discharge ports of the primary heat exchanger 30. The flue gases then enter the AGT adsorber 10 for removal of gaseous sulfur compounds and gaseous nitrogen compounds. The AGT adsorber 10 is in fluid communication with the inlet ports of the secondary heat exchanger 32 via the coupling box 35, which houses an AGT adsorber 26. The appropriate size of the primary heat exchanger 30 allows the AGT adsorber 10 to operate at optimal temperatures for absorbing SOx and NOx redox, and the secondary heat exchanger 32 recovers heat from the condensing vapor (collecting neutral condensate) and minimizes the exhaust temperature of the flue gases. As shown in FIG. 8, the AGT adsorber 26 in the coupling box 35 is a flow-through monolithic substrate with a cubic rectangle geometry. An optional silica mat (not shown) may be disposed between the coupling box 35 and the flow-through monolithic substrate 26. The monolithic substrate may include or may be formed from a silicate (e.g., cordierite) or stainless steel.

EXAMPLE

In one example, a Rheem 23.4KW (80K BTU/HR) natural gas furnace with an AGT adsorber in the flue gas flow path was evaluated under ANSI/ASHRAE Standard 103-2017. A combustion and emissions analyzer was recorded $O_2$, $CO_2$, CO, and NOx concentrations, and a manometer was used to ensure the pressure drop of heating supply air is within the manufacturer recommended range (0.28 to 0.8 inches of water). The temperature difference between the supply air flow and return air flow was also monitored to ensure that $\Delta T_{supply}$ was within the range set by the test standard (22-39° C.). Data was recorded at a frequency of 1 Hz, and the condensate collection was performed manually.

Figure 9B:
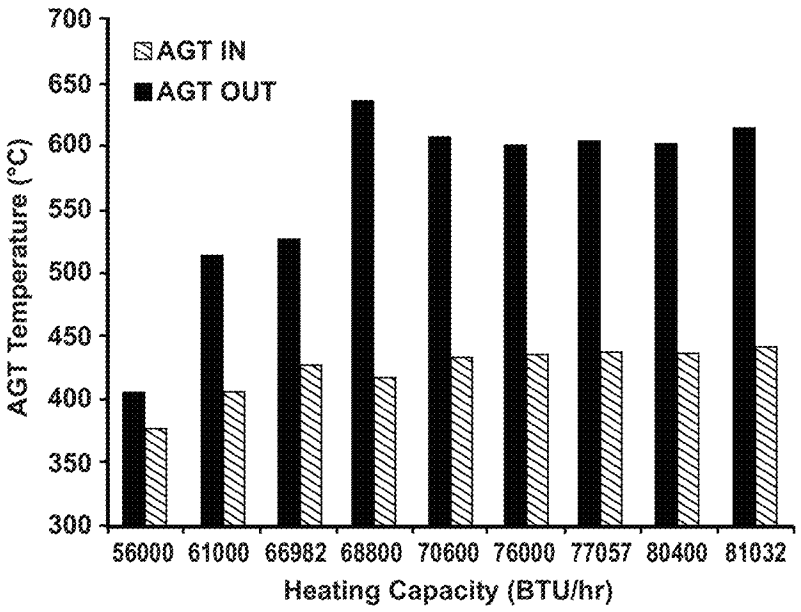
FIGS. 9A-9B include graphs illustrating AFUE and AGT temperature of a natural gas furnace including an AGT adsorber.
Figure 9A:
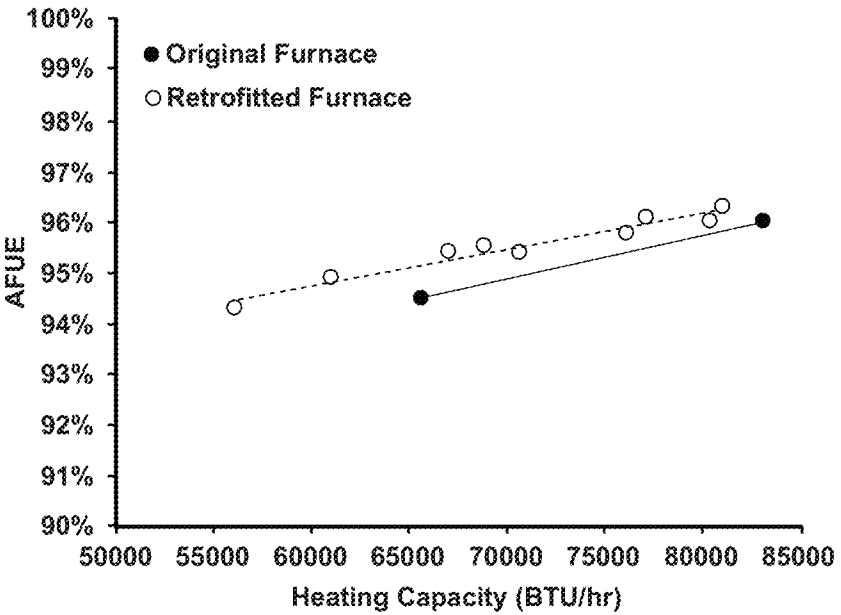

The natural gas furnace was test over various BTU input ratings ranging from 16.4KW (56,000BTU/HR) to 23.4KW (80,000BTU/HR). FIG. 9A shows the comparison of AFUE between the original Rheem furnace and the Rheem furnace having an AGT adsorber in the flue gas flow path. The results indicate that the retrofitted furnace achieved an improved AFUE, primarily owing to the ability of the AGT adsorber to oxidize CO, HC, methane, and formic acid. This observation is confirmed in FIG. 9B, which shows the AGT adsorber inlet temperature and outlet temperature, as measured using two type-K thermocouples upstream and downstream of the AGT adsorber. In particular, the temperature was significantly increased at the exit of the AGT adsorber. In FIGS. 9A and 9B, the tested AGT was wash coated with titanium dioxide and platinum nanoparticles followed by the application of platinum nanoparticles and cupric oxide.

Figure 10B:
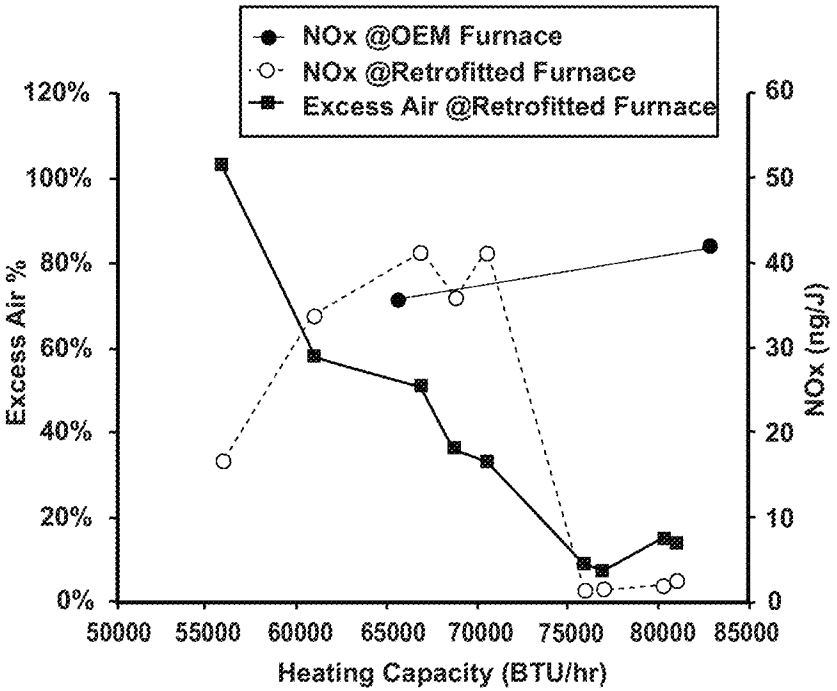
FIGS. 10A-10B include graphs illustrating pH values and NOx emissions control of a natural gas furnace including an AGT adsorber.
Figure 10A:
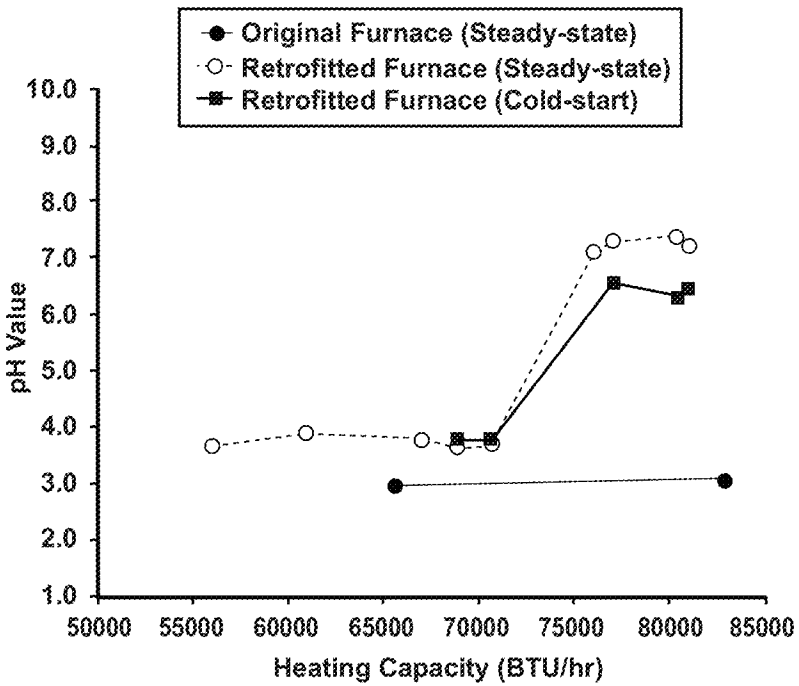

During the tests, condensate samples were collected from both cold start and steady-state cases. FIG. 10A displays a comparison of condensate acidity of the retrofitted AGT-enabled furnace with the original furnace at various heating capacities. The steady-state data confirmed that the pH of the collected condensate at >22.6KW (>77K BTU/HR) is slightly above 7 while the pH of the condensate from the original furnace was 3-4. This indicates that the AGT adsorber removed more than 99.9% of the acidic content from the condensate. In cold start cases, the results show that the pH of the collected condensate is 6.3-6.5, which is slightly less than the steady-state data. The cold-start results indicate that more than 99.9% of the acidic content from the condensate is reduced by the AGT adsorber. In FIGS. 10A and 10B, the tested AGT was wash coated with titanium dioxide and platinum nanoparticles followed by the application of platinum nanoparticles and cupric oxide.

Further, the recorded data indicated that the AGT adsorber performed NOx redox and formic gas/CO/HC/$CH_4$ oxidation. These results indicate that the AGT adsorber can be employed in a natural gas furnace that yields a clean flue gas and neutral condensate, alleviating long-term environmental issues related to soil, water, and air and enable more efficient furnace operation. FIG. 10B shows the NOx reduction. The results demonstrate that the AGT adsorber enables 1-2 nanograms/joule of NOx emissions from the retrofitted furnace. Without the AGT adsorber, the NOx emissions were 35-40 nanograms/joule, indicating that the AGT adsorber reduces NOx emissions by more than 90%.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A method for treating flue gases from a natural gas furnace, the method comprising:

positioning an acidic gas trap adsorber in an exhaust gas flow path between a primary heat exchanger and a secondary heat exchanger; and contacting a combustion waste gas from a natural gas furnace with the acidic gas trap adsorber, the combustion waste gas including gaseous sulfur compounds and gaseous nitrogen compounds, wherein the acidic gas trap adsorber comprises:

a shell canister, a divergent cone coupled to an upstream side of the shell canister, a convergent cone coupled to a downstream side of the shell canister, a flow-through monolithic substrate within the shell canister, the flow-monolithic substrate including plurality of channels extending in a longitudinal direction between the divergent cone and the convergent cone, the plurality of channels each defining channel surfaces that are orthogonal to the longitudinal direction, and a catalyst coating on the channel surfaces of the flow-through monolithic substrate, the catalyst coating including a plurality of nanotubes that are oriented in a non-parallel direction with respect each other, the plurality of nanotubes comprising a metal oxide sorber component for trapping the gaseous sulfur compounds, trapping the gaseous nitrogen compounds, or trapping gaseous nitrogen redox from the combustion waste gas, the metal oxide sorber component comprising an oxide of Ti, Cu, Ba, Mn, Zr, Zn, Sr, Ca, Li, K, Na, Al, Ce or mixtures thereof.

2. The method of claim 1, wherein the flow-through monolithic substrate comprises a cordierite or stainless steel honeycomb structure.

3. The method of claim 1, further including positioning a mat comprising silica between the flow-through monolithic substrate and the shell canister.

4. The method of claim 1, wherein the flow-through monolithic substrate is wash coated with titanium dioxide followed by the application of platinum nanoparticles and cupric oxide.

5. The method of claim 1, wherein the primary heat exchanger is a tubular heat exchanger, and wherein the secondary heat exchanger is a tube and fin heat exchanger.

6. A method for treating flue gases from a natural gas furnace, the method comprising:

positioning an acidic gas trap adsorber in an exhaust gas flow path between a primary heat exchanger and a secondary heat exchanger; and contacting a combustion waste gas from a natural gas furnace with the acidic gas trap adsorber, the combustion waste gas including gaseous sulfur compounds and gaseous nitrogen compounds, wherein the acidic gas trap adsorber comprises:

a catalyst coating on a flow-through monolithic substrate, the catalyst coating including a metal oxide sorber component for trapping the gaseous sulfur compounds, trapping the gaseous nitrogen compounds, or trapping gaseous nitrogen redox from the combustion waste gas, the metal oxide sorber component comprising an oxide of Ti, Cu, Ba, Mn, Zr, Zn, Sr, Ca, Li, K, Na, Al, Ce or mixtures thereof, wherein the flow-through monolithic substrate comprises a zinc oxide that is wash coated with $BaCO_3$ nanoparticles.

7. A system for treating flue gases from a natural gas furnace, the system comprising:

an acidic gas trap adsorber in an exhaust gas flow path between a primary heat exchanger and a secondary heat exchanger, wherein the acidic gas trap adsorber comprises:

a shell canister, a divergent cone coupled to an upstream side of the shell canister, a convergent cone coupled to a downstream side of the shell canister, a flow-through monolithic substrate within the shell canister, the flow-monolithic substrate including plurality of channels extending in a longitudinal direction between the divergent cone and the convergent cone, the plurality of channels each defining channel surfaces that are orthogonal to the longitudinal direction, and a catalyst coating on the channel surfaces of the flow-through monolithic substrate, the catalyst coating including a plurality of nanotubes that are oriented in a non-parallel direction with respect each other, the plurality of nanotubes comprising a metal oxide sorber component for trapping gaseous sulfur compounds, trapping gaseous nitrogen compounds, or trapping gaseous nitrogen redox from the combustion waste gas, the metal oxide sorber component comprising an oxide of Ti, Cu, Ba, Mn, Zr, Zn, Sr, Ca, Li, K, Na, Al, Ce or mixtures thereof.

8. The system of claim 7, wherein the flow-through monolithic substrate comprises a cordierite or stainless-steel honeycomb structure.

9. The system of claim 7, further comprising a mat comprising silica disposed between the flow-through monolithic substrate and the shell canister.

10. The system of claim 7, wherein the flow-through monolithic substrate is wash coated with titanium dioxide followed by the application of platinum nanoparticles and cupric oxide.

* * * * *